US005586904A

United States Patent [19]

Huang

[11] Patent Number: 5,586,904

[45] Date of Patent: Dec. 24, 1996

[54] SAFETY STRUCTURE IMPROVEMENT OF A BULB SOCKET

[76] Inventor: Ming H. Huang, 2, Lane 65, Cheng Kong Road, Hsinchu, Taiwan

[21] Appl. No.: 404,494

[22] Filed: Mar. 17, 1995

[51] Int. Cl.[6] ..... H01R 4/24

[52] U.S. Cl. ..... 439/419; 439/395

[58] Field of Search ..... 439/395, 417, 439/418, 419, 660, 66, 340, 336, 666, 667

[56] References Cited

U.S. PATENT DOCUMENTS

| | | | |
|---|---|---|---|
| 3,955,876 | 5/1976 | Knuppel | 439/700 |
| 5,380,215 | 10/1995 | Huang | 439/419 |
| 5,492,483 | 2/1996 | Cheng et al. | 439/419 |

FOREIGN PATENT DOCUMENTS

| | | | |
|---|---|---|---|
| 0621112 | 5/1961 | Italy | 439/666 |

*Primary Examiner*—David L. Pirlot

*Attorney, Agent, or Firm*—Morton J. Rosenberg; David I. Klein

[57] ABSTRACT

A safely operable bulb socket structure is provided wherein a positive conductor plate is securely retained in a support assembly within the socket. The positive conductor plate is configured and retained within the socket in such manner that it forms a secure, resiliently biased contact with an electric conduction terminal of a bulb received in the socket. The resulting structure insures safe yet efficient illumination of the bulb.

1 Claim, 5 Drawing Sheets

SAFETY STRUCTURE IMPROVEMENT OF A BULB SOCKET

BACKGROUND OF THE INVENTION

In a conventional bulb socket, electricity conduction is by means of two conductor plates, i.e., a positive terminal conductor plate and a negative terminal conductor plate, individually touching a tip contact and a ring contact of a light bulb. The upper ends of the two conductor plates are configured to have sharp tips that pierce through the outer plastic layers of conductor wires to touch metal conductors. To avert the danger of eletrical short circuits and insure proper operation, it is vitally important that appropriate means be employed to cause the conductor plates to form secure with the lightbulb's contact terminals. The means adopted in a conventional bulb socket for negative terminal conductor plates is an insertion groove arranged on the inside surface of the socket that can receive the tail end of a negative terminal conductor plate. The method is definitely effective. However, for positive terminal conductor plates no ideal method is presented so far and thus there still exist potential dangers in a conventional bulb socket.

The principal object of the invention is to provide an improved safety structure of a bulb socket that has an improved support means for the positive terminal conductor plate such that safe and efficient operation may be realized.

The detailed structure and features of the present invention are described as follows with reference to the accompanying drawings.

DETAILED DESCRIPTION OF THE INVENTION

Figure 1:
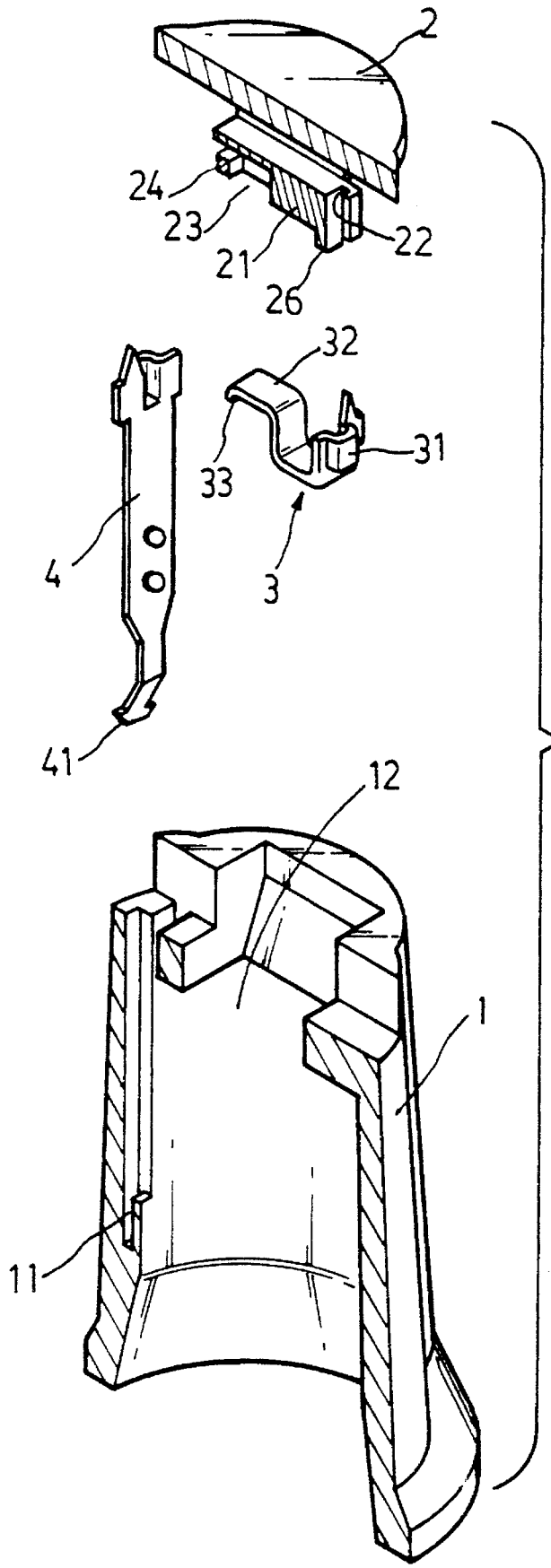
FIG. 1 is an exploded perspective view, partially cut-away, of an embodiment of a safety structure of the invention.
Figure 2:
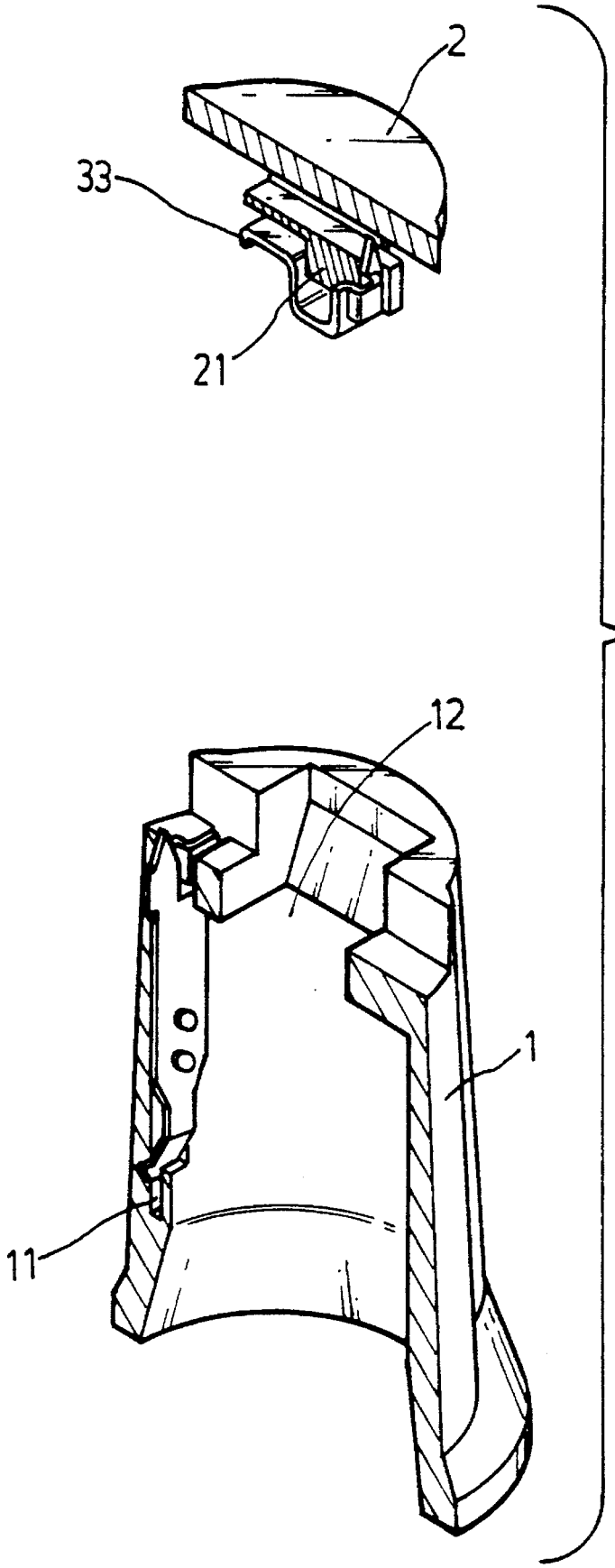
FIG. 2 is an exploded perspective view, partially cut-away, of the safety structure of FIG. 1 in a partly assembled state.
Figure 3:
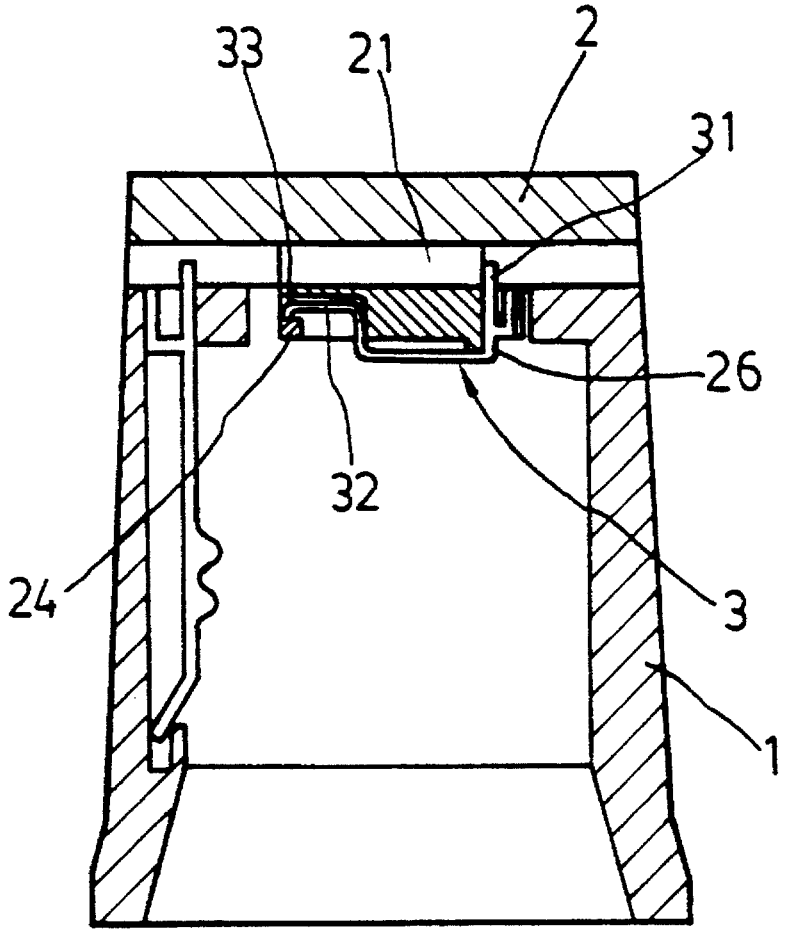
FIG. 3 is a cross-sectional of an assembled bulb socket according to the invention.

Referring to FIGS. 1 and 2, the invention includes a socket (1), a top cover (2), a positive terminal conductor plate (3), and a negative terminal conductor plate (4). as in a prior art structure, the negative terminal conductor plate (4) is fixed by inserting its tail end (41) into an insertion groove (11) disposed on the inside surface of the socket (1) to insure firm engagement. An opening (12) is formed on the top of the socket (1) and a supportive seat (21) is situated under the top cover (2) and thereby engageable with said opening (12) to integrate the socket (1) as a whole. The supportive seat (21) is provided with a long slot (22) at its one end, a recessed area (23) at its lower portion which extends to a raised block (24) formed adjacent the other end of the supportive seat (21). The positive terminal conductor plate (3) has a sharp tip (31) lying inside the long slot (22) and a rear portion (32) seated in the recessed area (23). The positive terminal conductor plate (3) further has a curved rear end (33) that hangs on the raised block (24) as it mounts on the supportive seat (21) as shown in FIG. 3.

Figure 4:
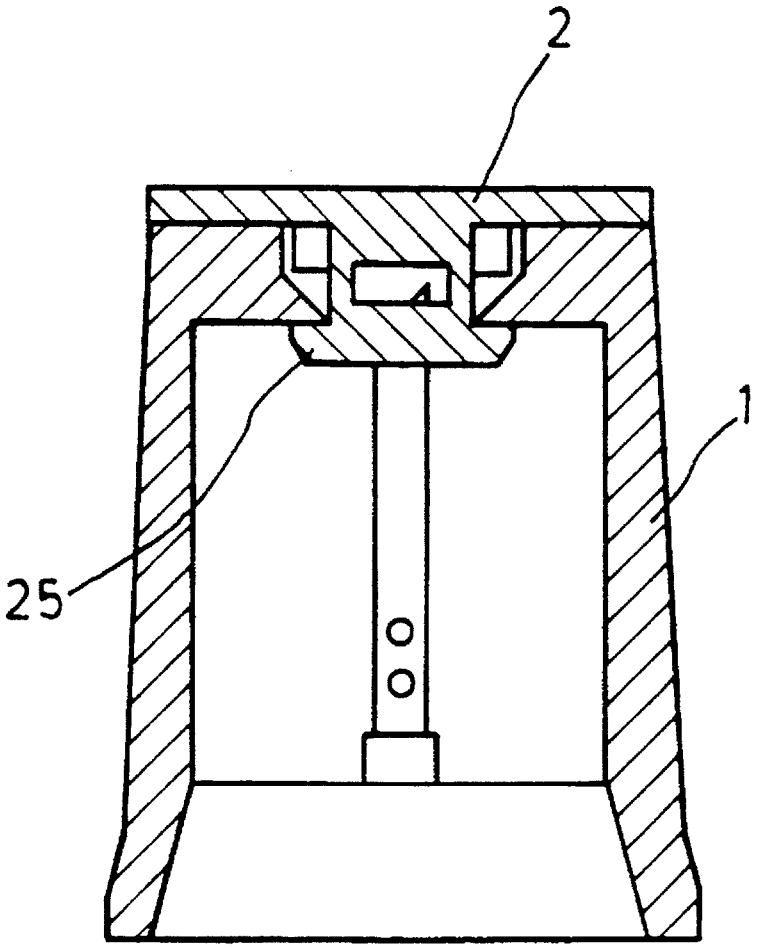
FIG. 4 is a cross-sectional view of the assembled bulb socket shown in FIG. 3 taken after rotating the cross-sectional plane by 90° about a vertical rotation axis FIG. 3.

As can be seen from FIG. 4, the supportive seat (21) of the top cover (2) is configured to have chamfered barbs (25) at its lower rim which serve to secure the top cover in position over the socket (1).

Figure 5:
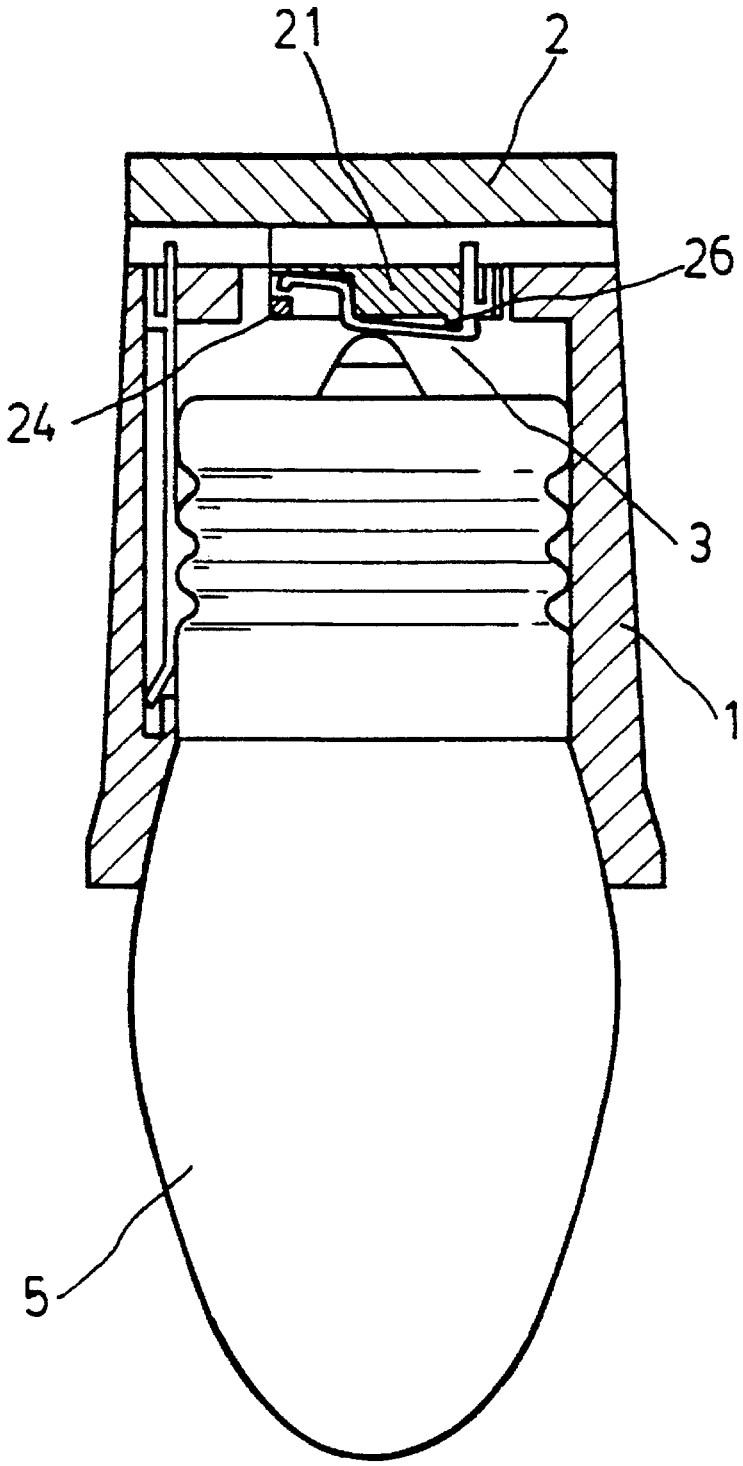
FIG. 5 is an elevational view, partially cut-away, of the socket of the present invention in use in the field.

In such a structure, a light bulb (5) can be securely yet operatively retained as shown in FIG. 5. The resulting configuration of the supportive seat of the top cover, the positive terminal conductor plate (3), which is positively constrained at its rear end, in association with the negative terminal conductor plate ensures safe operation. Furthermore, a bossed portion (26) is arranged on the bottom surface of the supportive seat (21). When a bulb (5) is seated in the socket, the tip contact of the bulb will depress the positive terminal conductor plate (3) against its central area, which in turn deflects the rear portion upwards. As a result, the rear portion of the positive conductor plate acquires a bias force, which reinforces the conductive connection.

What is claimed is:

1. A lamp socket assembly for securely and operatively receiving therein a lamp having an electric conduction terminal comprising:

(a) a socket member extending in an axial direction, said socket member having a sidewall portion and a base portion defining a chamber for coaxially receiving at least a portion of said lamp, said base portion having formed therein a through opening, said sidewall portion having formed therein an elongate insertion groove;

(b) a cover member coupled to said base portion of said socket member, said cover member having a supporting seat extending in said axial direction into said opening of said base portion of said socket member, said supporting seat having front and side surfaces extending substantially in said axial direction, said side surface having an elongate slot formed therein, said front surface having a recessed area and a raised block protruding therefrom, said supporting seat having formed thereon a boss portion projecting in said axial direction and a plurality of barb projections, said barb projections engaging said base portion of said socket member to secure said coupling of said cover member therewith;

(c) a first terminal conductor plate received in said insertion groove of said socket member; and, (d) a second terminal conductor plate coupled to said supporting seat of said cover member, said second terminal conductor plate having a first end, a second end, and an intermediate plate portion extending therebetween, said first end securely engaging said raised block of said cover member supporting seat, said second end having formed thereon a pointed portion received in said elongate slot of said cover member supporting seat, said intermediate plate portion being adapted for resilient deflection by said electric conduction terminal of said lamp into contact with said boss portion of said cover member supporting seat when said lamp is received in said lamp socket assembly.

* * * * *